US005888133A

United States Patent [19]

Mori et al.

[11] Patent Number: 5,888,133

[45] Date of Patent: Mar. 30, 1999

[54] AIR CONDITIONER

[75] Inventors: Nobuyuki Mori; Yoshimi Kawai, both of Kawasaki, Japan

[73] Assignee: Fujitsu General Limited, Kawasaki, Japan

[21] Appl. No.: 865,180

[22] Filed: May 29, 1997

[30] Foreign Application Priority Data

Jun. 6, 1996 [JP] Japan ..... 8-143869

[51] Int. Cl.[6] ..... F24F 13/075

[52] U.S. Cl. ..... 454/318; 454/315; 454/321

[58] Field of Search ..... 454/202, 313, 454/315, 318, 319, 320, 321

[56] References Cited

FOREIGN PATENT DOCUMENTS

| | | | |
|---|---|---|---|
| 2-057856 | 2/1990 | Japan | 454/313 |
| 3-5661 | 1/1991 | Japan | 454/319 |
| 4-139351 | 5/1992 | Japan | 454/313 |
| 4-260748 | 9/1992 | Japan | 454/313 |
| 6-137667 | 5/1994 | Japan | 454/313 |
| 6-288607 | 10/1994 | Japan | 454/313 |

*Primary Examiner*—Harold Joyce
*Attorney, Agent, or Firm*—Kanesaka & Takeuchi

[57] ABSTRACT

In an air conditioner, at least one up-down wind direction board rotates in an up-down direction around almost horizontal rotation axis within an air outlet, and a plurality of lateral wind direction boards rotating laterally are provided around rotation axes as the center which are almost orthogonal to the rotation axis of said up-down wind direction board. Also a diffuser constituting a part of the air outlet is provided rotationally around an almost horizontal rotation axis as the center at the lower portion of the air outlet. A motor for driving the up-down wind direction board is provided at the side of one side wall portion of the air outlet. The up-down wind direction board is set by said motor to any arbitrary angle of tilt between the initial stop position closing said air outlet and maximum open position almost vertically downward. When the said up-down wind direction board is in a range from the position of a particular angle of tilt to said maximum open position between said up-down wind direction board and said diffuser, a drive force transmitting device provided is capable of transmitting the movement of said up-down wind direction board to said diffuser thereby permitting the driving of both the up-down wind direction board and diffuser by a single motor.

8 Claims, 8 Drawing Sheets

AIR CONDITIONER

BACKGROUND OF THE INVENTION

1. Field of the Invention

The present invention relates to an air conditioner, and more particularly to drive means for rotating wind direction louver boards in an air outlet of said air conditioner and a diffuser installed below said air outlet.

2. Description of the Related Art

At the air outlet of the air conditioner, up-down wind direction boards (flaps) are provided for adjusting heat-exchanged air uniformly toward a room or, in some case, for locally adjusting the wind direction. FIG. 7 is a sectional view indicating an overall construction of the conventional air conditioner, and FIG. 8 is an enlarged cross-sectional view of the air outlet portion. Also, the air conditioner comprises an indoor unit and an outdoor unit, and the air conditioner described herein means the indoor unit of a wall mounted type.

That is, this air conditioner as an indoor unit is equipped with a housing 1 designed as an indoor wall mounted type; in this example, air inlets 2 are provided respectively at the front face and the top face of the housing 1, and an air outlet 5 is provided at the lower portion of the front face of the housing 1. A heat exchanger 3 and an air blowing fan 4 are provided in an air passage from the air inlet 2 to air outlet 5 inside the housing 1.

Inside the air outlet 5, provided are two up-down wind direction boards such as flaps 7 and 8 for adjusting the up-down wind direction and a plurality of lateral air direction boards such as slats of louver 6 for adjusting wind motion in lateral direction. Generally, the flaps 7 and 8 are arranged at the front side of the lateral wind direction boards (louver) 6 when seen from the external side of the air conditioning unit (within the room). And the flaps are supported by support pieces 7*b* and 8*b* suspended from an upper wall portion of the air outlet 5 in such a manner that their rotation axes 7*a* and 8*b* become almost horizontal. That is, the up-down flaps 7 and 8 are rotatable around the horizontal rotation axes 7*a* and 8*a* as the centers between the initial stop position closing the air outlet 5 and the maximum open position at which the flaps are almost in vertically downward direction as shown in FIG. 7 and FIG. 8.

Though only one louver slat 6 is shown in FIG. 7 and FIG. 8, actually a plurality of slats are provided in the direction orthogonal to the paper surface of the drawings. Each slat 6 of the lateral wind direction board (louver) is supported through a bush 6*a* by the upper wall portion of the air outlet 5 in such a manner that each slat 6 will rotate laterally around the axis of rotation which is almost orthogonal to the axis of rotation of the flaps 7 and 8. Also, an arm 6*b* is connected to each bush 6*a*, and a clip 6*c* for synchronously rotating each slat 6 is attached to said arm 6*b*.

As the air blowing fan 4 is operated, air is sucked from the air inlet 2, heat-exchanged by a heat exchanger 3 and then blown to the inside of room from the air outlet 5 and, at that time, the lateral wind direction is adjusted by the lateral wind direction boards (louver) and, at the same time, the up-down wind direction is adjusted by up-down direction boards (flaps) 7 and 8.

In this way, the various wind directions can be adjusted. However, if the flaps 7 and 8 are set almost downward vertically to the maximum open position as shown in FIG. 7 and FIG. 8 during a heating operation or a rapid cooling operation, for example, then the wind blows hard against the flaps 7 and 8, and the gap between the lower flap 8 and the bottom edge of the air outlet 5 becomes narrower, so that the air blowing efficiency is decreased.

Therefore at the bottom of the air outlet 5, a diffuser 9 constituting a part of said air outlet 5 is installed rotatably around an almost horizontal rotation axis 9*a*. And if the opening angle of the flaps 7 and 8 is made larger as stated above, then the diffuser 9 is rotated counter-clockwise in FIG. 7 and FIG. 8 and the air outlet 5 is made wider.

In this way, in rotating the flaps 7 and 8 and the diffuser 9, conventionally an exclusive motor 11 for driving the flaps and a motor 19 for driving the diffuser are installed respectively.

The motor 11 for driving the flaps is installed on one side of the side wall portion 5*a* of the air outlet 5 as shown by a chain line in FIG. 8, and a drive gear 20 is attached to a drive shaft 11*a* of the motor. Driven gears 22 and 23 are attached respectively to the rotation axes 7*a* and 8*a* of the flaps 7 and 8, and these driven gears 22 and 23 are interlocked with a drive gear 20 through an intermediate gear 21. By doing this, the flaps 7 and 8 are synchronously driven by the motor 11 and can be set to an arbitrary angle of tilt between the initial stop position closing the air outlet 5 and the maximum open position almost vertically downward as shown in FIG. 7 and FIG. 8.

The motor 19 for driving the diffuser is arranged at a position on lower rear side of a main body casing 1*a* determining a boundary line of an air passage inside the housing 1 and rotates the diffuser 9 to the position shown in FIG. 7 and FIG. 8 when the flaps 7 and 8 are rotated to the side of the maximum open position, and the frontage of the air outlet 5 is widened. In this way, the motor 19 rotates the diffuser 9 in response to the movement of the flaps 7 and 8, and the motor control is performed by control means such as CPU (central processing unit, not shown in the drawings).

By the use of the diffuser 9, the wind direction adjustment can be performed more effectively without lowering the efficiency of air blowing. However, in the conventional way, there are certain problems because the diffuser driving motor 19 and its motor drive circuit are required, and thus an increase in the production cost is unavoidable. In addition, a space for mounting the motor 19 is required and this is troublesome in making the housing 1 compact.

The present invention has been made for solving the conventional problems stated above. And its object is to provide an air conditioner capable of driving the up-down direction boards (flaps) and the diffuser by a single motor without requiring a motor exclusively for the diffuser.

SUMMARY OF THE INVENTION

To achieve the objects of the present invention described above, a first present invention has a housing with an air inlet and an air outlet formed therein, a heat exchanger and an air blowing fan are provided within an air passage from said air inlet to said air outlet inside the housing, also provided in said air outlet are at least one up-down wind direction board (flap) which rotates in an up-down direction around an almost horizontal axis of rotation as well as a plurality of lateral wind direction boards (louvers) rotating in a lateral direction around the axis of rotation which is almost orthogonal to the axis of rotation of said up-down wind direction board, a diffuser constituting a part of said air outlet is provided in a rotatable manner around an almost horizontal axis of rotation at the lower portion of said air outlet and; a motor for driving said up-down wind direction board is located on the side of one side wall portion of said air outlet. In the air conditioner, said up-down wind direction board can be set to an arbitrary angle of tilt by said motor between the initial stop position closing said air outlet and the maximum open position directed to almost vertically downward, and also a driving force transmitting means is provided for transmitting the movement of said up-down wind direction board to said diffuser when said up-down wind direction board is located in a range from a particular position of an angle of tilt to said maximum opening position for said up-down wind direction boards and said diffuser.

In this first invention, the driving force transmitting means is equipped with a first link having a base end portion for coaxially coupling the drive shaft of the motor to the rotation axis of the up-down wind direction boards (flap), a second link having a base end portion coaxially coupled to the rotation axis of the diffuser and a second coupling pin provided at the position being eccentric from the axis of said base end portion, and a first rod coupling the first coupling pin to the second coupling pin; if the up-down wind direction board is in the range of a position of the particular angle of tilt and the initial stop position between the second coupling pin and the first rod, then movement of the up-down wind direction board is not transmitted to the diffuser; and if the up-down wind direction board is in the range from the position of the particular angle of slope to the maximum open position, then a lost motion mechanism is provided for transmitting the movement of the up-down wind direction board to the diffuser.

In this case, the lost motion mechanism comprises the second coupling pin and an ellipse hole at the first rod side which is fitted to the second coupling pin.

Also in the first invention, the position of the particular angle of tilt of the up-down wind direction board is almost in a horizontal position; when the up-down wind direction board is at the initial stop position, the first coupling pin is located below a virtual reference line connecting the base end portion of the first link to the second coupling pin of the second link; when the up-down wind direction board is rotated from the initial stop position to almost horizontal position, the first coupling pin moves to the upper portion of the virtual reference line.

To achieve the objects stated above, in the second invention, a housing formed by the air inlet and air outlet is provided, a heat exchanger and an air blowing fan are provided in the air passage from the air inlet to the air outlet within the housing; within the air outlet, two up-down wind direction boards each rotating in an up-down direction around an almost horizontal axis of rotation are provided at the positions separated up and down and back and forth; also a plurality of lateral wind direction boards rotating in lateral directions around the axis of rotations almost orthogonal to the axis of rotation of the up-down wind direction boards are provided; in the lower portion of the air outlet, a diffuser constituting a part of the air outlet is provided in a rotatable manner around an almost horizontal axis of rotation; also, a motor for driving the up-down wind direction boards is provided on the side of one side wall portion of the air outlet; in the air conditioner set to an arbitrary angle of tilt between the initial stop position closing the air outlet by the up-down wind direction boards by means of the motor and the maximum open position directed almost vertically downward, one of the up-down wind direction boards is coupled to the motor by actuation; between one of the up-down wind direction boards and the other up-down wind direction board, first driving force transmitting means is coupled for coupling in such a manner that both the up-down wind direction boards will be rotated synchronously; between the other up-down wind direction board and the diffuser, second driving force transmitting means is provided for transmitting the movement of the other up-down wind direction board when each up-down wind direction board is in the range from the position of a particular angle of tilt to the maximum open position.

In this second invention, the first driving force transmitting means is equipped with a first link having a base end portion coaxially coupling a drive shaft of said motor to the axis of rotation of the one up-down wind direction board and a first coupling pin provided at the position eccentric from the axis of the base end portion, a third link having a base end portion coaxially coupled to the rotation axis of said other up-down wind direction board and a third coupling pin and a fourth coupling pin respectively provided at the different positions eccentric from the axis of the base end portion, and a second rod coupling the first coupling pin to the third coupling pin. The second driving force transmitting means is equipped with a second link having a base end portion coupled coaxially to a rotation angle of said diffuser and a second coupling pin provided at the position eccentric from the axis of the same base end portion; and if said other up-down wind direction board is in the range of the initial stop position and the position of the particular angle of tilt between the second coupling pin and the first rod, then the movement of the same other up-down wind direction board is not transmitted to said diffuser; and if the same other up-down wind direction board is in the range from said particular position of the angle of tilt to the maximum open position, then a lost motion mechanism transmits the movement of the same other up-down wind direction to the diffuser.

In this case, the lost motion mechanism comprises the second coupling pin and an ellipse hole at the first rod side which is to be fitted to the same second coupling pin.

Also according to the second invention, when each up-down wind-direction board is at the initial stop position, the fourth coupling pin is located below the virtual reference line connecting the base end portion of the third link to the second coupling pin of said second link, and when said respective up-down wind direction boards have been rotated from the initial stop position to almost horizontal positions, the fourth coupling pin moves above the virtual reference line.

Moreover, both the first and second inventions are equipped with spring means for energizing the diffuser toward the upper initial position for reducing the width of the opening (frontage) of the air outlet; and when the diffuser is energized to the initial position by the same spring means, the rear end portion of the upper surface of the same diffuser comes into contact with the front end portion of the main body casing determining the boundary line for the air passage within the housing, and then positioning of its initial position can be performed.

In addition, both the first and second inventions have characteristics in that the driving force transmitting means is mounted between a hinge plate constituting the one side wall portion of the air outlet and a motor base supporting the motor.

These and other objects, features and advantages of the present inventions will become clear from the following description of the preferred embodiment taken in conjunction with the accompanying drawings.

DESCRIPTION OF THE PREFERRED EMBODIMENTS

The first embodiment of the air conditioner according to the present invention will be described hereinafter with reference to FIG. 1 and FIG. 2 of the accompanying drawings. In this first embodiment, any portions that are the same or deemed to be the same as the conventional ones will be marked with the same reference codes thereby omitting the explanation thereof.

In this first embodiment, one up-down wind direction board 7 is provided inside the air outlet 5. That is, its rotation axis 7*a* is supported almost horizontally by a supporting piece 7*b* suspended from an upper wall portion of the air outlet 5.

Also, at the lower portion of the air outlet 5, a diffuser 9 constituting a part of the air outlet 5 is provided in a rotatable manner around an almost horizontal rotation axis 9*a*.

Figure 2:
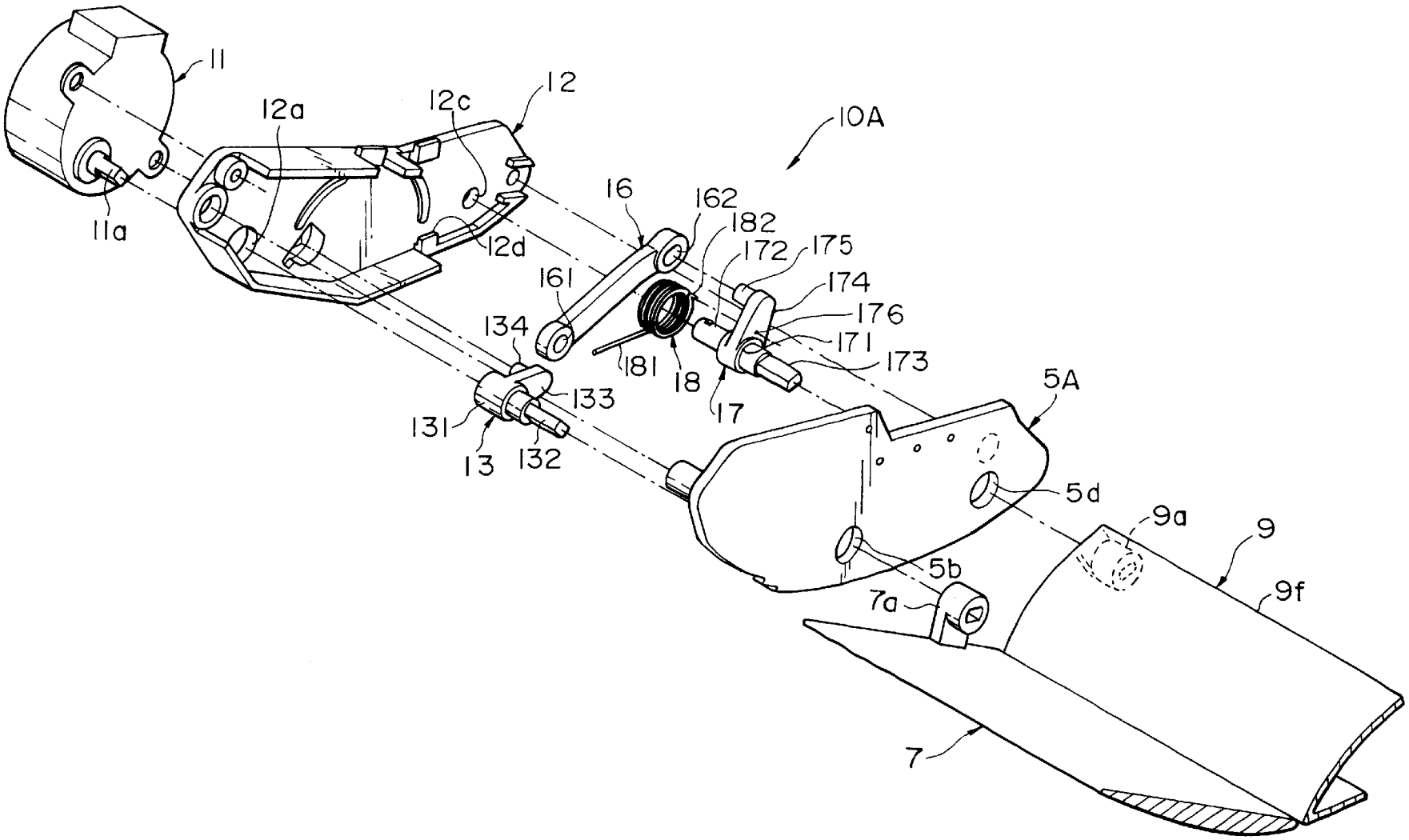
FIG. 2 is an exploded perspective view for explaining the drive force transmitting means of the first embodiment.

The air outlet 5 is surrounded by a lower wall portion including an upper wall portion and the diffuser 9 and a pair of right and left side walls and, in this embodiment, one of the side wall portions is formed by a hinge plate 5A shown in FIG. 2.

At the rear side (opposite side of air blower 5) of this hinge plate 5A, a motor base 12 for mounting a motor 11 is arranged at a predetermined gap with the hinge plate 5A, and a drive force transmitting means 10A for transmitting the drive force of the motor 11 to the up-down wind direction board 7 and the diffuser 9 is housed in the gap.

The drive force transmitting means 10A is equipped with a first link 13 for coaxially coupling a drive shaft 11*a* of the motor 11 and the rotation axis 7*a* of the up-down wind direction board 7, a second link 17 coaxially coupled with the rotation axis 9*a* of the diffuser 9, and a first rod 16 bridged between the first link 13 and the second link 17.

The first link 13 has a cylindrical base end portion 131, though other end side of the base end portion 131 is not shown in the drawings, thereby forming a coupling hole to be fitted in the drive shaft 11*a* of the motor 11, and a coupling shaft 132 to be inserted into a shaft hole of the rotation axis 7*a* of the up-down wind direction board 7 is provided coaxially with the coupling hole at one side on the other end side of the base end portion 131.

At the base end portion 131 of the first link 13, an arm 133 extending in the direction normal to the rotation axis is provided integrally, and a first coupling pin 134 is provided at the tip portion of the same arm 133. That is, the first coupling pin 134 is located eccentrically from the base end portion 131.

The second link 17 has a cylindrical base end portion 171, and its one end side has a rotation shaft 172 supported by a shaft receiving hole 12*c* formed at the motor base 12. Also, at the other end side of the base end portion 171, a coupling shaft 173 to be inserted into a shaft hole of the rotation axis 9*a* of the diffuser 9 is provided coaxially with the rotation shaft 172.

At the base end portion 171 of the second link 17, an arm 174 extending in the direction orthogonal to the rotation axis is provided integrally, and the tip portion of the same arm 174 is provided with a second coupling pin 175. That is, the second coupling pin 175 is provided at a position eccentric from the base end portion 171.

At the hinge plate 5A, a bearing hole 5*b* for supporting the base end portion 131 of the first link 13 and a bearing hole 5*d* for supporting the base end portion 171 of the second link 17 are formed. Also, at the motor base 12, a hole 12*a* for inserting the drive shaft 11*a* of the motor 11 is formed in addition to the bearing hole 12*c*. The first rod 16 has a first coupling hole 161 to be fitted to the first coupling pin 134 on its one end side, and the second coupling hole 162 to be fitted to the second coupling pin 175 is provided on other end side.

In this case, a second coupling hole 162 is an ellipse hole (slit-shaped hole) having the minor axis almost equal to the diameter of the second coupling pin 175 and the major axis formed like a slit in the length direction of the same first rod 16.

That is, there is a play (a clearance which does not couple mechanically) along the length direction of a first rod 16 between the second coupling pin 175 and the second coupling hole 162, and this play constitutes the lost motion mechanism described later.

Figure 1:
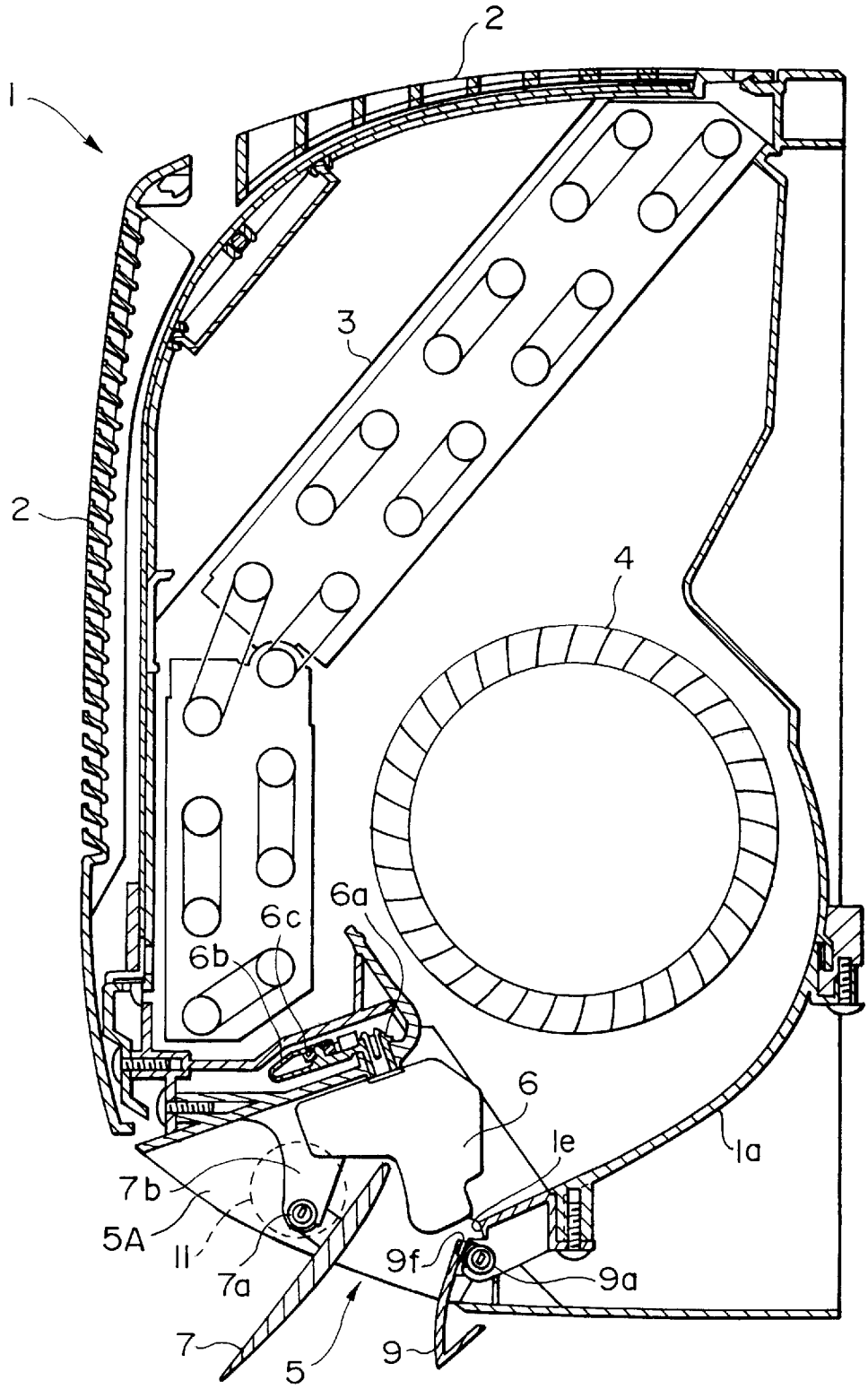
FIG. 1 shows the overall internal construction of the air conditioner as a first embodiment according to the present invention.

The second link 17 is provided with spring means for energizing the diffuser 9 upward (clockwise direction in FIG. 1). In this embodiment, a coil spring 18 is used as the spring means. One end 181 of this coil spring 18 is attached to a hook 12*d* formed to a motor base 12. An attaching hole 176 is formed to the arm 174 of the second link, and the other end of the coil spring 18 is attached to the attaching hole 176.

Figure 3A:
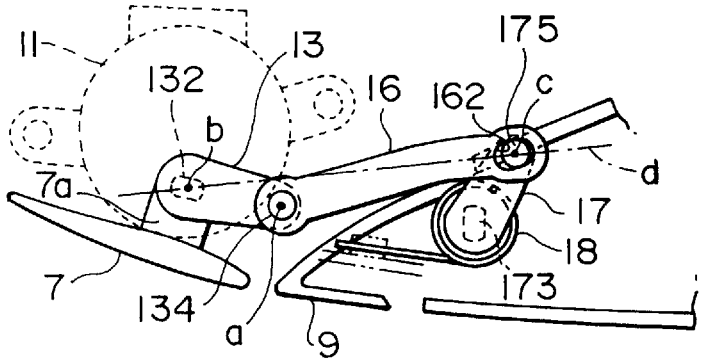
FIG. 3A to FIG. 3C show the operations for the first embodiment of the invention.

The diffuser 9 is energized upward by this coil spring 18 and is held to the initial position shown in FIG. 3A in normal state. In this case, the upper rear end portion 9*f* of the diffuser 9 is utilized as positioning means for its initial position. That is, it is so designed that the upper rear end portion 9*f* of the diffuser 9 comes into contact with the front end portion 1*e* of the main body casing 1*a* when the diffuser 9 is in the initial position.

According to this, there is no need to separately provide positioning means such as stopper, it is more advantageous costwise, and also no gap is created with the main body casing 1*a* when the diffuser is in initial position, so that noise such as wind-blowing sound is not generated.

Next, the operation of the first embodiment will be explained based on FIG. 3A to FIG. 3C. FIG. 3A shows a stop state of the air conditioner or an early stage of the initial state such as warning-up of the operation start in which the air outlet 5 is closed by the up-down wind direction boards 7, that is, the up-down wind direction board 7 is in initial state position, and also the diffuser 9 is held to the initial position by the coil spring 18.

Figure 3B:
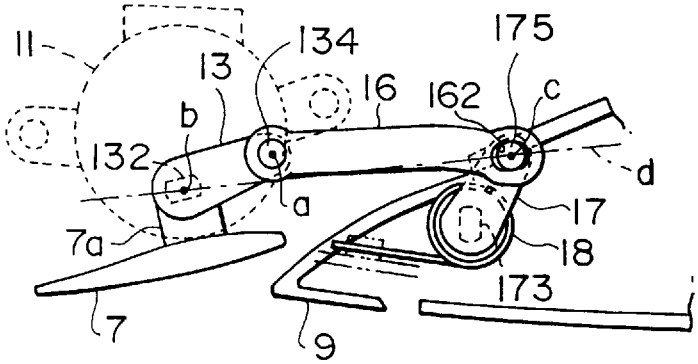

In FIG. 3B, the up-down wind direction board 7 is rotated by the motor 11 from the initial stop position to the counter-clockwise direction, and the board is set almost in horizontal position. In this first embodiment, within the rotation range of the initial stop position of the up-down wind direction boards 7 to the almost horizontal position, the movement of the first rod 16 is absorbed by the play between the second coupling pin 175 to the second coupling hole 162; by this lost motion mechanism, the drive force of the motor 11 is not transmitted to the diffuser 9.

Figure 3C:
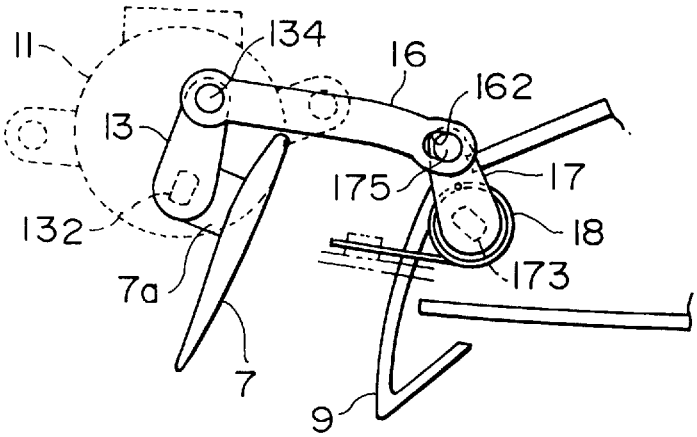

In succession, when the up-down wind direction board 7 is further rotated counter-clockwise by the motor 11, to the vertically downward direction to the maximum opening position side as shown in FIG. 3C, the play between the second coupling pin 175 and the second coupling hole 162 disappears, and the drive force of the motor 11 is transmitted to the diffuser 9 through the first link 13, the first rod 16 and the second link 17. In this way, the diffuser 9 is rotated counter-clockwise against the energizing force of the coil spring 18, and the frontage of the air outlet 5 is widened.

As described above, where the up-down wind direction board 7 is set almost at a horizontal position, the diffuser 9 is not open, therefore, the cold air can be sent out almost in a horizontal direction during cooling operation without directly sending cold air to the users.

Also, when the up-down wind direction board 7 is turned toward the maximum open position side in the vertical downward direction during a heating operation, for example, the diffuser 9 is opened in response to its movement thereby performing effective heating operation creating no drop in the efficiency of air supply.

In this first embodiment, when up-down wind direction board 7 is in an initial state of FIG. 3A relative to a line as reference line d which is connecting the center point b of the base end portion 131 of the first link 13 to the center point c of the second coupling pin 175 of the second link 17, the coupling portion a between the first coupling pin 134 and the first coupling hole 161 is located in such a manner that the coupling portion a comes below the reference line d; and when the up-down wind direction board 7 is turned almost up to the horizontal position of FIG. 3B, the coupling portion a is moved above the reference line d.

According to the above, when the up-down wind direction board 7 is rotated in the range between the initial state position of FIG. 3A and an almost horizontal position of FIG. 3B, the coupling portion a will pass above the dead point of the reference line d, so that the play between the second coupling pin 175 and the second coupling 162 can be made to a minimum, therefore, play is hardly felt even if a user pushes the diffuser 9 with the hand and thus a high grade can be maintained for the products.

Figure 4:
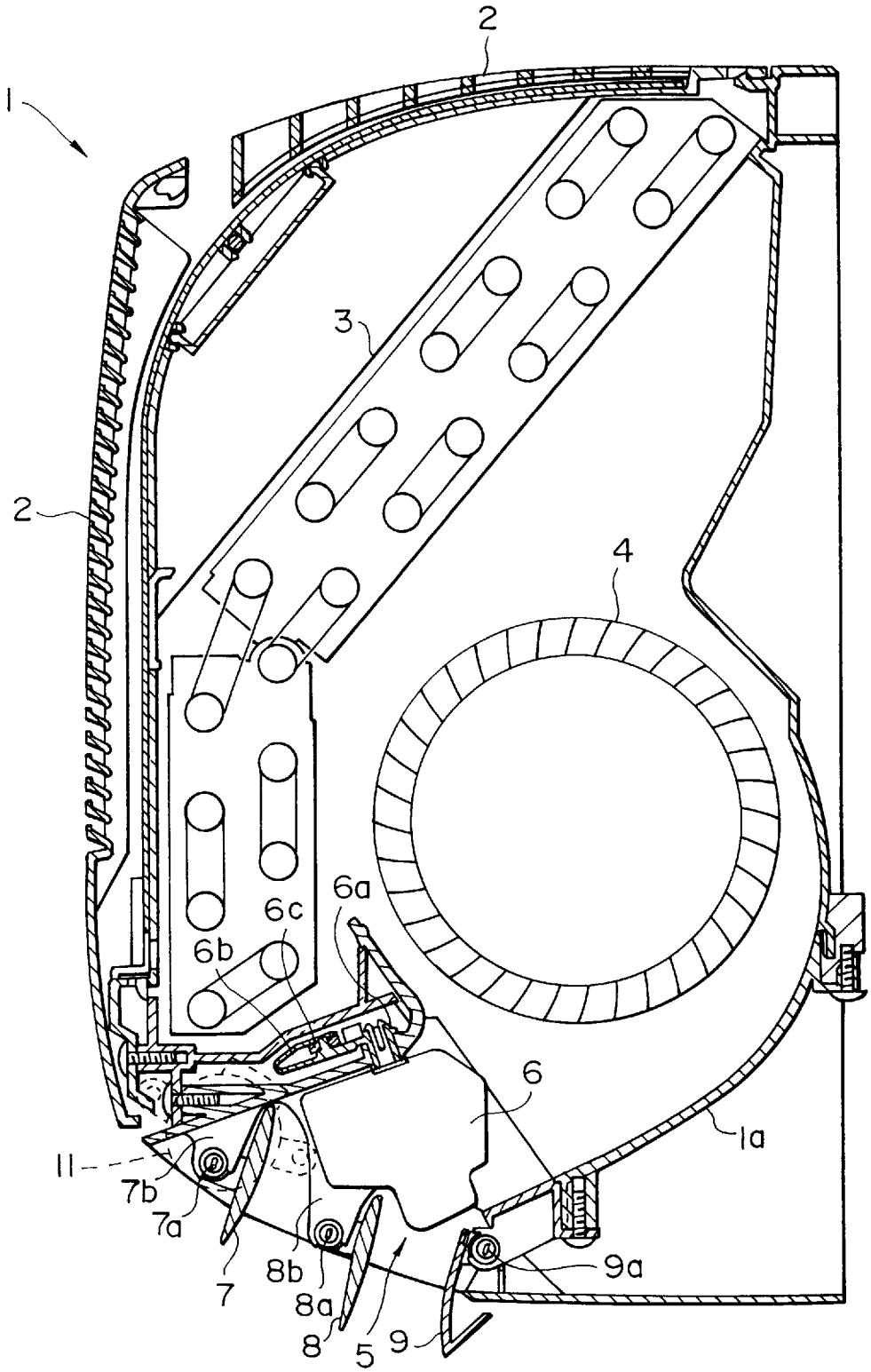
FIG. 4 is a section showing the overall internal construction of the air conditioner as the second embodiment of this invention.

Now the second embodiment of FIG. 4 to FIG. 6 will be explained. If the up-down wind direction board 7 of the first embodiment is a first up-down wind direction board, then a second up-down wind direction board 8 is added to the air outlet 5 in the second embodiment and, accordingly, drive force transmitting means changed. Also, the diffuser 9 is has a configuration as same as that of the first embodiment, and for the portions not different from those of the first embodiment, the same reference codes or numbers used in the first embodiment are adopted thereby omitting the explanation.

Figure 7:
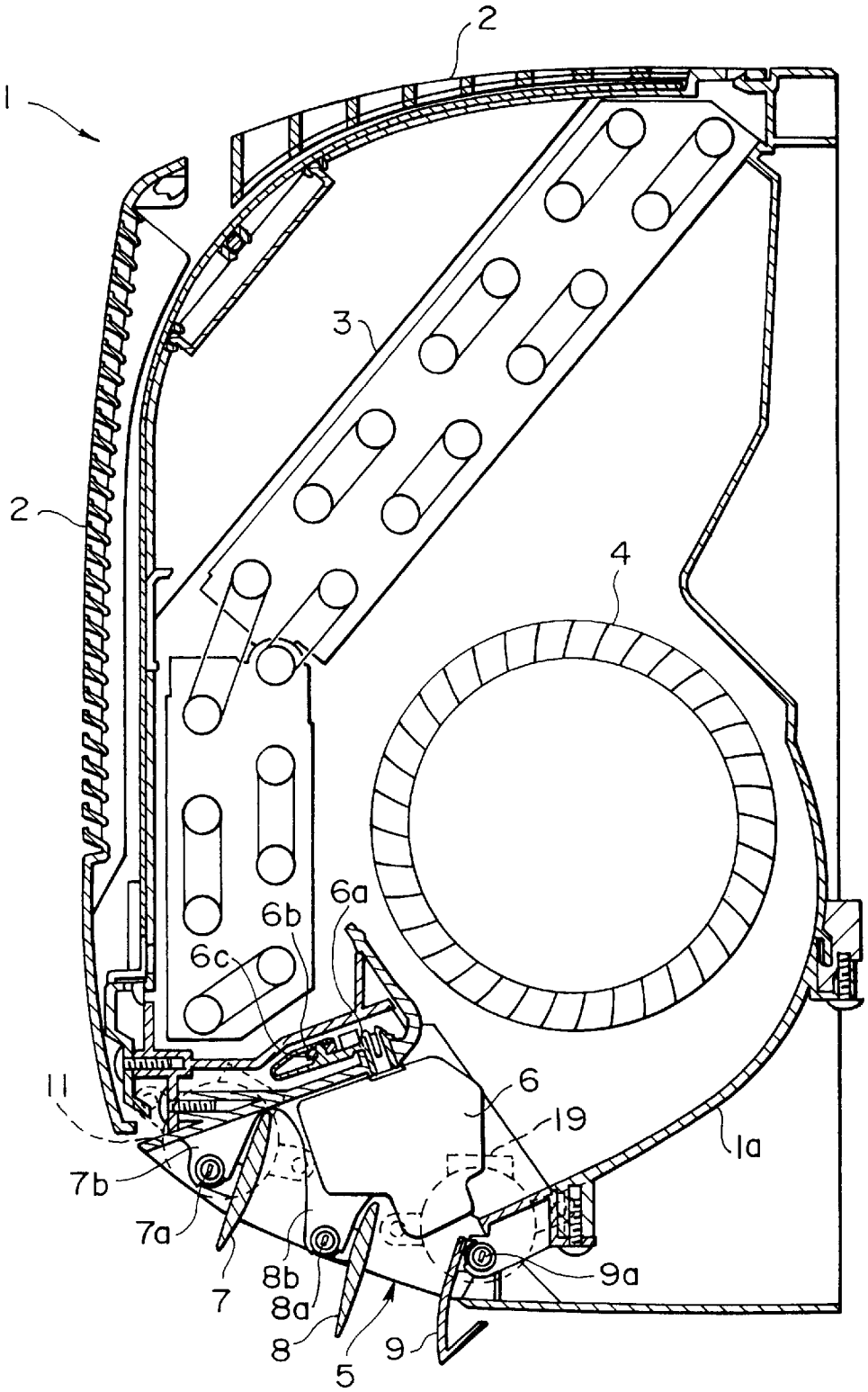
FIG. 7 PRIOR ART
FIG. 7 is a section of the internal construction of an air conditioner as the prior art.
Figure 8:
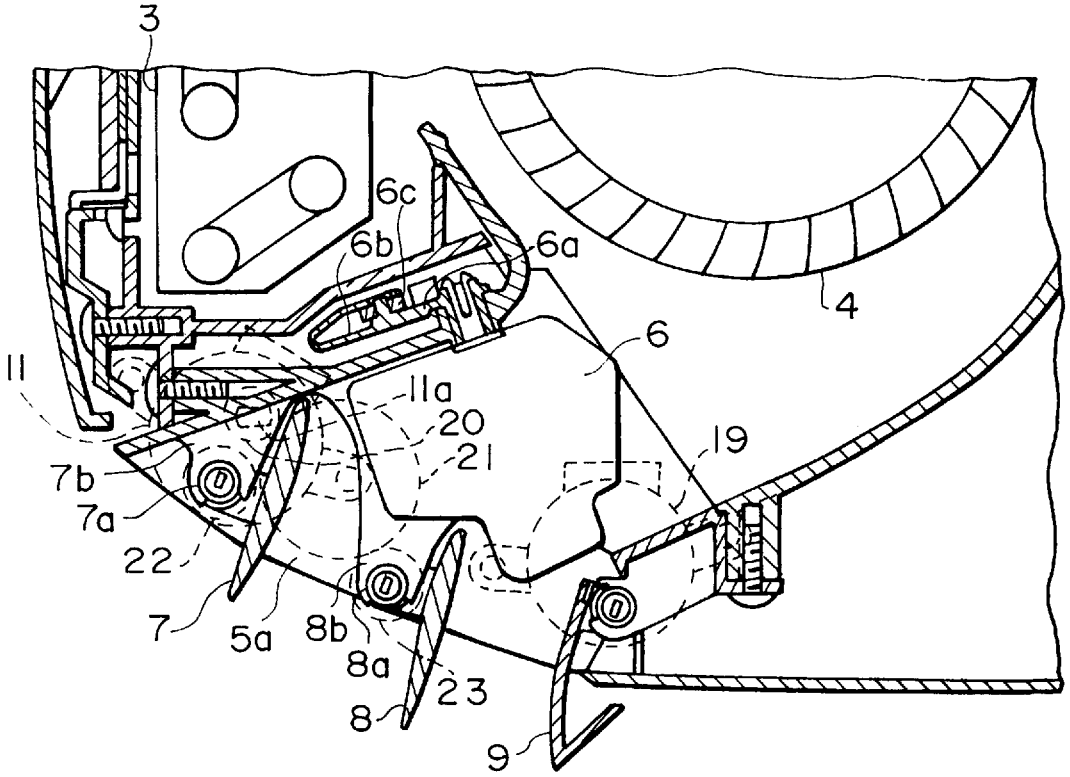
FIG. 8 PRIOR ART
FIG. 8 is a section showing the configuration of the air outlet portion of said prior art.

The first up-down wind direction board 7 and the second up-down wind direction board 8 are supported by support pieces 7*b* and 8*b* suspended from the upper wall portion of the air outlet 5 in such a manner that the rotation axes 7*a* and 8*a* become almost horizontal as same as the conventional example of FIG. 7 as explained previously. Also, with respect to the positional relation between both the up-down wind direction boards 7 and 8, the first up-down wind direction board 7 is located at an upper position at the front side of the air outlet 5 and the second up-down wind direction board 8 is in a lower position at the diagonally rear of the first up-down wind direction board 7 when the air outlet 5 is seen from the room side. That is, the second up-down wind direction board 8 is arranged between the first up-down wind direction board 7 and diffuser 9. Both the up-down wind direction boards 7 and 8 are synchronously rotated by the motor 11 between the initial stop position closing the air outlet 5 and the maximum open position almost downward vertically as same as the case of the first embodiment.

Figure 5:
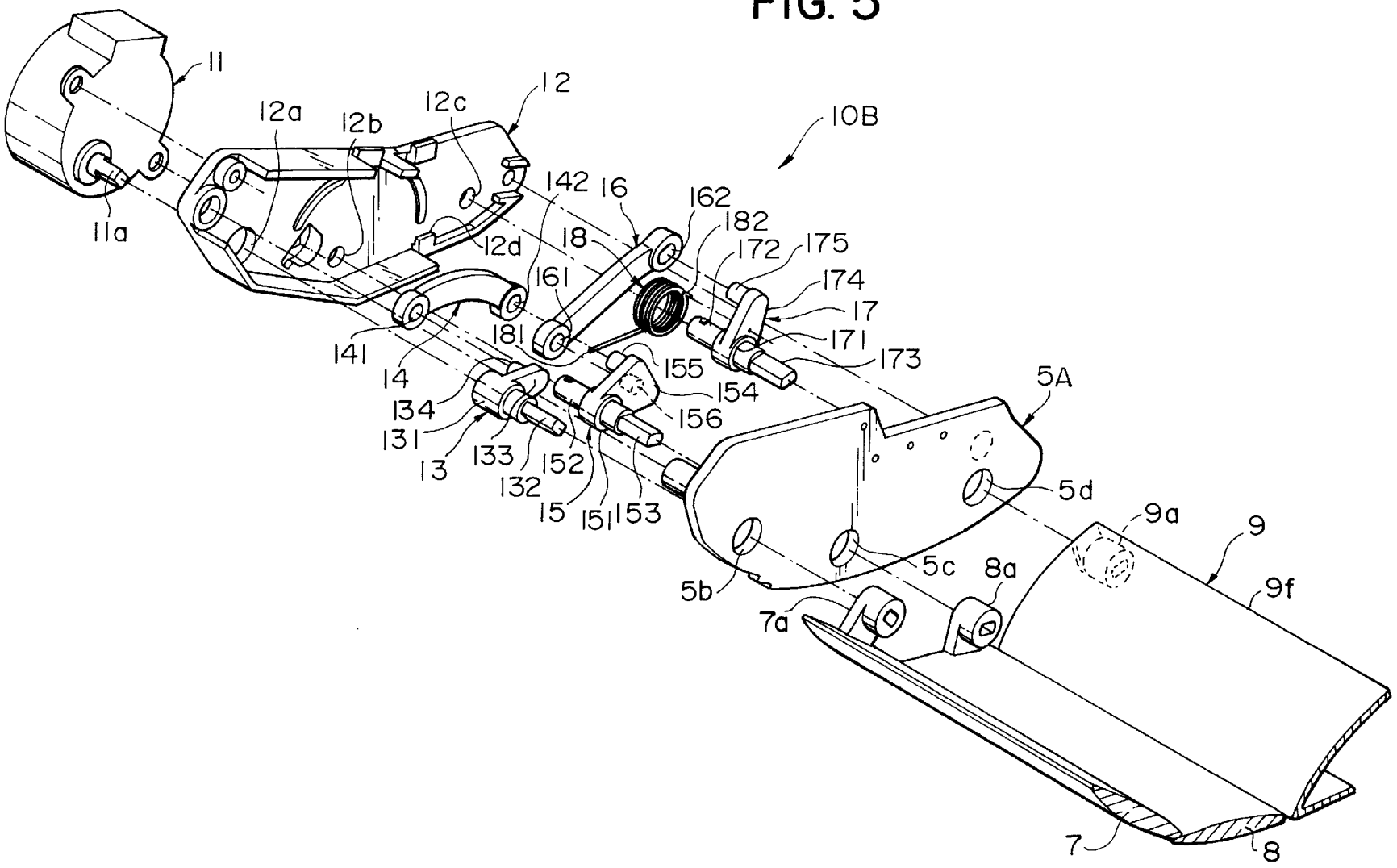
FIG. 5 is an exploded perspective view for explaining the drive force transmitting means of the second embodiment.

As shown in FIG. 5, the drive force transmitting means 10B of the second embodiment is equipped with the first drive force transmitting means coupling the first up-down wind direction board 7 and the second up-down wind direction board 8 and with the second drive force transmitting means coupling the second up-down wind direction board 8 to the diffuser 9 because the second up-down wind direction board 8 is arranged between the first up-down wind direction board 7 and the diffuser 9.

The first drive force transmitting means contains the first link 13 for coaxially coupling the drive shaft 11*a* of the motor 11 to the rotation axis of the first up-down wind direction board 7, the third link 15 to be attached to the rotation axis 8*a* of the second up-down wind direction board 8, and a second rod 14 for coupling the first link 13 to the third link 15.

The third link 15 has a cylindrical base end portion 151 and, at its one end side, a rotation shaft 152 is provided which is borne by the bearing hole 12*b* formed in a motor base 12. Also, at the other end side of the base end portion 151, a coupling shaft 153 to be inserted into the shaft hole of the rotation axis 8*a* of the second up-down wind direction board 8 is provided coaxially with the rotation shaft 152.

At the base end portion 151 of the third link 15, an arm 154 extending in a direction orthogonal to its rotation axis is provided integrally, and the third coupling pin 155 and fourth coupling pin 156 forming a pair up and down are provided at the tip portion of the same arm 154. In this case, the arm 154 has a fan shape widening around the base end portion 151 as a center, and the third coupling pin 155 is arranged at a position above the fourth coupling pin 156 (refer to FIG. 6A).

The second rod 14 is equipped with coupling holes 141 and 142 at both the ends, and one of the first coupling hole 141 is fitted to the first coupling pin 134 of the first link 13, and the other second coupling hole 142 is fitted to the third coupling pin 155 of the third link 15. Also, in the hinge plate 5A, the bearing hole 5*c* for bearing the base end portion 151 of the third link 15 is additionally formed.

The second drive force transmitting means contains the fourth coupling pin 156 of the third link 15, the second link 17 attached to the diffuser 9, and the first rod 16 coupling the second coupling pin 175 of the same second link 17 to the fourth coupling pin 156 of the third link 15.

The first coupling hole 161 of the first rod 16 is fitted to the fourth coupling pin 156 of the third link 15, and other second coupling hole 162 is fitted to the second coupling pin 175 of the second link 17; even in this second embodiment, the second coupling hole 162 of the first rod 16 is an ellipse hole (slit-shaped hole) having a predetermined play for the second coupling pin 175.

Figure 6A:
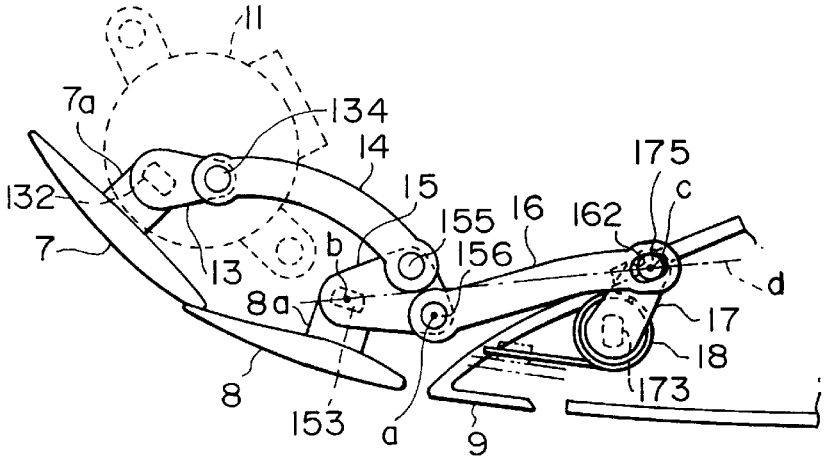
FIG. 6A to FIG. 6C show the operations of the second embodiment.

Next, the operation of the second embodiment will be explained based on FIG. 6A to FIG. 6C. FIG. 6A is for the initial state where the air conditioner is in stop state or in worming-up time in an early stage of the operation start in which the air outlet 5 is closed by the first and second up-down wind direction boards 7 and 8, that is, both up-down wind direction boards 7 and 8 are in an initial stop position, and the diffuser 9 is also held in the initial position by the coil spring 18.

Figure 6B:
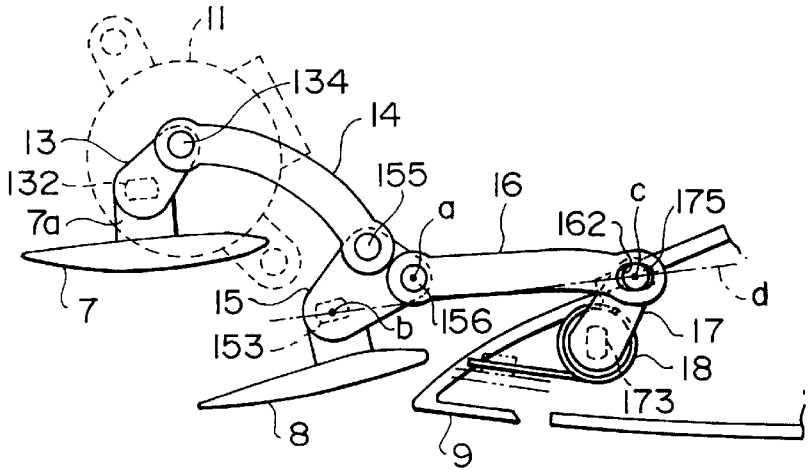

In FIG. 6B, the first and second up-down wind direction boards 7 and 8 are rotated counter-clockwise by the motor 11 from the initial stop state and are set to almost horizontal position. The drive force of the motor 11 is transmitted to the first rod 16 through the first link 13, the second rod 14 and the third link 15 and, even in this second embodiment, the movement of the first rod 16 is absorbed by the play within the rotation range between the initial stop position of the up-down wind direction boards 7 and 8 to almost horizontal position, and the drive force of the motor 11 is not transmitted to the diffuser 9 by the lost motion mechanism stated above.

Figure 6C:
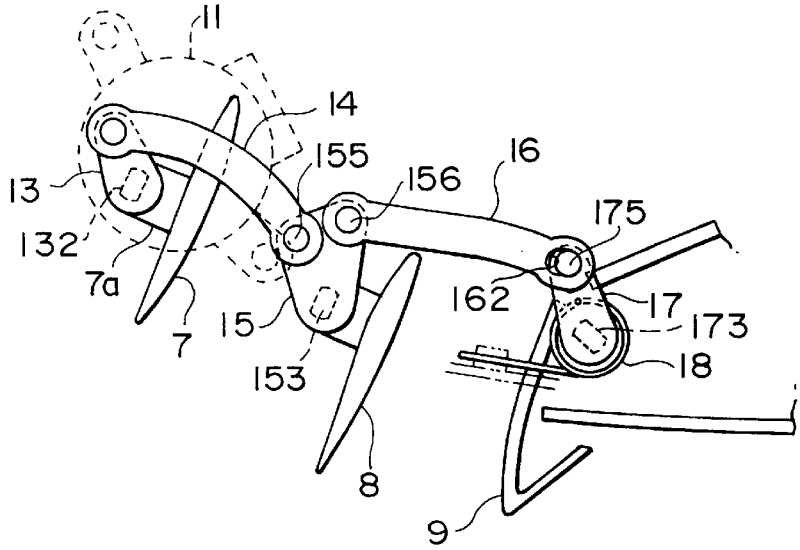

In succession, when the up-down wind direction boards 7 and 8 are rotated in the counter-clockwise direction by the motor 11 toward the maximum open position side in the vertical downward direction as shown in FIG. 6C, a play between the second coupling pin 175 and the second coupling hole 162 is lost and the drive force of the motor 11 is transmitted to the diffuser 9 through the first link 13, second rod 14, third link 15, first rod 16 and second link 17. In this way, the diffuser 9 is rotated counter-clockwise against the energized force of the coil spring 18, and the frontage of the air outlet 5 is widened.

Even in the second embodiment as described above, if the up-down wind direction boards 7 and 8 are set almost in a horizontal position, the diffuser 9 is not opened, so that the cold air can be effectively sent out almost in horizontal direction without directly sending the cold air to the users during cooling operation.

Also, when the up-down wind direction boards 7 and 8 are rotated toward the maximum open position side in the vertically downward direction during heating operation, for example, the diffuser 9 is opened in response to that movement, so that effective heating operation can be performed without any decrease in air supply efficiency.

In this second embodiment, a line connecting the center point b of the base end portion 151 of the third link 15 to the center point c of the second coupling pin 175 of the second link 17 being a reference line d when the up-down wind direction boards 7 and 8 are in the initial state of FIG. 6A, the coupling portion a between the fourth coupling pin 156 and the first coupling hole 161 of the first rid 16 is located below said reference line d; and when the up-down wind direction boards 7 and 8 have been rotated almost to the horizontal position of FIG. 6B, the coupling portion a is moved above the reference line d.

According to the above, as explained also in the first embodiment, the coupling portion a will pass on the dead point of the reference line d when the up-down wind direction boards 7 and 8 are rotated between the initial state position of FIG. 6A and almost the horizontal position of FIG. 6B, so that the play between the second coupling pin 175 and the second coupling hole 162 can be made to a minimum, so that rattling is hardly felt even though the user pushes the diffuser 9 by the hand, and a high grade can be assured for the products.

Also in the second embodiment, the first up-down wind direction board 7 is coupled to the drive shaft lb of the motor 11 through the first link 13 but the coupling of the second up-down wind direction board 8 to the drive shaft 11*b* of the motor 11 may be made through the third link 15 by changing the mounting position of the motor 11 for the motor base 12.

Also, a plurality of parts such as links, rods and coupling pins are respectively contained in the drive force transmitting means 10A and 10B, codes such as first and second are given to the part names but it should be understood that this was done for the convenience of identifying each part merely for the explanation.

In any case, this invention is not limited by said preferred embodiments explained above, and contains the items varied within the range of engineering philosophy.

As being apparent from the above description, according to the present invention, the motor for driving the up-down wind direction boards can be used also as a drive source for the diffuser. Therefore, the motor for driving the diffuser and its motor drive circuit becomes unnecessary, by which cost reduction can be realized, a compact housing can be provided, and these are specially desired for wall mounted type air conditioners.

What is claimed is:

1. An air conditioner comprising:

a housing with an air inlet and an air outlet formed therein, a heat exchanger and an air blowing fan provided within an air passage extending from said air inlet to said air outlet inside the housing, at least one up-down wind direction board situated in the air outlet of the housing and rotating in an up-down direction around a substantially horizontal axis, a plurality of lateral wind direction boards situated in the air outlet of the housing and rotating laterally around axes substantially orthogonal to the axis of the up-down wind direction board, a diffuser constituting a part of said air outlet rotatably provided around a substantially horizontal axis at a lower portion of the air outlet, a motor for driving said up-down wind direction board located on a side wall portion of the housing near the air outlet, said up-down wind direction board being set to an arbitrary angle of tilt by said motor between an initial stop position for closing said air outlet and a maximum open position directed to substantially vertically downward, and drive force transmitting means for transmitting movement of the up-down wind direction board to the diffuser when the up-down wind direction board is located in a range from a particular tilting position to the maximum opening position, said drive force transmitting means including:

a first link having a base end portion for coaxially coupling a drive shaft of the motor to a rotation axis of the up-down wind direction board, and a first coupling pin located at a position eccentric from the base end portion, a second link having a base end portion coupled to a rotation axis of the diffuser, and a second coupling pin located at a position eccentric from the base end portion thereof, a first rod which couples said first coupling pin to said second coupling pin, and a lost motion mechanism which does not transmit a movement of said up-down wind direction board to said diffuser by means of the second coupling pin and the first rod when the up-down wind direction board moves from the initial stop position to the particular tilting position, and which transmits the movement of said up-down wind direction board to the diffuser when the up-down wind direction board is moved from the particular tilting position to the maximum open position.

2. The air conditioner according to claim 1, wherein said lost motion mechanism comprises said second coupling pin and an elliptical hole set to said second coupling pin formed in said first rod side.

3. The air conditioner according to claim 1, wherein said first coupling pin is located below a virtual reference line connecting the base end portion of said first link to said second coupling pin of said second link when the particular tilting position of said up-down wind direction board is almost at a horizontal position and said up-down wind direction bard is located at said initial stop position, and said first coupling pin is able to move above said virtual reference line when said up-down wind direction board has rotated from said initial stop position to the almost horizontal position.

4. An air conditioner comprising:

a housing with an air inlet and an air outlet formed therein, a heat exchanger and an air blowing fan provided within an air passage extending from said air inlet to said air outlet inside the housing, two up-down wind direction boards situated in the air outlet of the housing and rotating in an up-down direction around substantially horizontal axes, said two up-down wind direction boards being separated vertically and laterally in the air outlet, a plurality of lateral wind direction boards situated in the air outlet of the housing and rotating laterally around axes substantially orthogonal to the axes of the up-down wind direction boards, a diffuser constituting a part of said air outlet rotatably provided around a substantially horizontal axis at a lower portion of the air outlet, a motor for driving said up-down wind direction boards located on a side wall portion of the housing near the air outlet, said up-down wind direction boards being set to an arbitrary angle of tilt by said motor between an initial stop position for closing said air outlet and a maximum open position directed to substantially vertically downward, first drive force transmitting means attached to the motor and coupling one up-down wind direction board and the other up-down wind direction board together for synchronous rotation with said one up-down wind direction board, said first drive force transmitting means including a first link having a base end portion for coaxially coupling a drive shaft of the motor to a rotation axis of the one up-down wind direction board, and a first coupling pin located at a position eccentric from the base end portion thereof; a third link having a base end portion coaxially coupled to a rotation axis of the other up-down wind direction board and an axis thereof, and third and fourth coupling pins respectively located at positions eccentric from the base end portion thereof; and a second rod for coupling the first coupling pin to the third coupling pin, second drive force transmitting means attached to the other up-down wind direction board for transmitting a movement of the other up-down wind direction board to the diffuser when the other up-down wind direction board is in a range from a particular tilting position to the maximum open position, said second drive force transmitting means including a second link having a base end portion coaxially coupled to a rotation axis of the diffuser; a second coupling pin located at a position eccentric from the base end portion thereof; and a first rod which couples the fourth coupling pin to the second coupling pin, and a lost motion mechanism which does not transmit a movement of the other up-down wind direction board to the diffuser by means of the second coupling pin and the first rod when the other up-down wind direction board moves from the initial stop position to the particular tilting position, and which transmits the movement of the other up-down wind direction board to the diffuser when the other up-down wind direction board is moved from the particular tilting position to the maximum open position.

5. The air conditioner according to claim 4, wherein said lost motion mechanism comprises a said second coupling pin and an elliptical hole at a side of said first rod fitted to said second coupling pin.

6. The air conditioner according to claim 4, wherein said fourth coupling pin is located below a virtual reference line connected from the base end portion of said third link to said second coupling pin of said second link, and said fourth coupling pin moves upward of said virtual reference line when each said up-down wind direction board has rotated from said initial stop position to an almost horizontal position.

7. The air conditioner according to claim 1, wherein spring means for energizing said diffuser toward a upper initial position so as to make the opening width of said air outlet narrower is provided; and if said diffuser is energized to the initial position by said spring means, the rear end portion of the upper surface of said diffuser comes in contact with a front end portion of a main body casing for establishing said air passage and thereby its initial position.

8. The air conditioner of claim 1, wherein said drive force transmitting means is housed between a hinge plate constituting the one side wall portion of said air outlet and a motor base supporting said motor.

* * * * *